US009370236B2

(12) United States Patent
Neuner et al.

(10) Patent No.: US 9,370,236 B2
(45) Date of Patent: Jun. 21, 2016

(54) COSMETIC CONTAINER WITH MULTIFUNCTIONAL INSERT

(71) Applicants: Charles P. Neuner, Amityville, NY (US); Robert Arrighi, Maplewood, NJ (US)

(72) Inventors: Charles P. Neuner, Amityville, NY (US); Robert Arrighi, Maplewood, NJ (US)

(73) Assignee: UNION TOOL & MOLD COMPANY, Maplewood, NJ (US)

( * ) Notice: Subject to any disclaimer, the term of this patent is extended or adjusted under 35 U.S.C. 154(b) by 206 days.

(21) Appl. No.: 13/999,013

(22) Filed: Jan. 2, 2014

(65) Prior Publication Data

US 2015/0182003 A1 Jul. 2, 2015

(51) Int. Cl.

| | |
|---|---|
| ***A46B 11/00*** | (2006.01) |
| ***A45D 40/26*** | (2006.01) |
| ***B65D 51/32*** | (2006.01) |
| *A45D 40/00* | (2006.01) |

(52) U.S. Cl.

CPC ..... *A45D 40/267* (2013.01); *B65D 51/32* (2013.01); *A45D 2040/0006* (2013.01); *A46B 2200/1046* (2013.01); *A46B 2200/1053* (2013.01)

(58) Field of Classification Search

CPC ..... A45D 34/046; A45D 40/267
USPC ..... 401/122
See application file for complete search history.

(56) References Cited

U.S. PATENT DOCUMENTS

| | | | | |
|---|---|---|---|---|
| 2,814,420 | A | 5/1953 | Elder, Jr., et al. | |
| 3,469,928 | A | 9/1969 | Widegren | |
| 3,780,186 | A * | 12/1973 | Reinhard | A23L 1/16 426/516 |
| 4,796,647 | A * | 1/1989 | Gueret | A45D 40/267 132/320 |
| 5,599,125 | A * | 2/1997 | Vasas | A45D 40/267 401/122 |
| 5,884,634 | A * | 3/1999 | Sheffler | A45D 34/046 132/218 |
| 6,503,487 | B1 * | 1/2003 | Ohba | A45D 40/268 132/216 |
| 7,374,358 | B2 | 5/2008 | Neuner et al. | |
| 7,467,905 | B2 | 12/2008 | Habatjou | |
| 8,210,761 | B2 | 7/2012 | Bouix et al. | |
| 8,272,140 | B2 | 9/2012 | Goldstein et al. | |
| 8,459,891 | B2 | 6/2013 | Lhoyer | |
| 8,529,147 | B2 | 9/2013 | Delage | |
| 8,894,311 | B2 * | 11/2014 | Gueret | A45D 40/265 401/118 |
| 2006/0198689 | A1 | 9/2006 | Neuner et al. | |
| 2006/0198690 | A1 | 9/2006 | Neuner et al. | |
| 2008/0219747 | A1 | 9/2008 | Vanoncini | |
| 2011/0255912 | A1 | 10/2011 | Lhoyer | |
| 2012/0132222 | A1 * | 5/2012 | Gueret | A45D 40/267 132/200 |

* cited by examiner

*Primary Examiner* — Jennifer C Chiang
(74) *Attorney, Agent, or Firm* — Deirdra M. Meagher

(57) ABSTRACT

A cosmetic container with a multifunctional insert neckpiece includes: a) a container having one of (a) a receiving groove and (b) a corresponding vertical one-way ratchet; and b) an integral multifunctional insert neckpiece having a downcomer extending down from a top orifice to establish a cosmetic wiper, and having an upper section with a cap attachment, and on its wall, the other of (a) the vertical one-way ratchet receiving groove and (b) the corresponding vertical one-way ratchet.

19 Claims, 12 Drawing Sheets

COSMETIC CONTAINER WITH MULTIFUNCTIONAL INSERT

BACKGROUND OF INVENTION a. Field of Invention

The present invention generally relates to cosmetic and other containers that utilize a brush-type applicator, such as lip gloss, make-up, nail polish and especially mascara. The invention involves the use of a neck insert in place of traditional wipers. This neck insert allows for the use of wide mouthed containers for easier fill, and serves to perform multiple functions: the single piece insert neckpiece includes the locking mechanism for permanent connection to the container, includes wipes that may be selected from a broad range of sizes and shapes, includes the cap connection—snap fit, screw-on, or otherwise, and completely inhibits accidental removal of the wiper and subsequent loss of product and perhaps loss of customer.

b. Description of Related Art

The following patents are representative of the field pertaining to cosmetic packaging and containers:

U.S. Pat. No. 8,529,147 B2 to Delage describes an applicator that may include: an applicator member; a handle that is generally elongate along a longitudinal axis; and a drive mechanism arranged to transform an action, exerted by a user on a control member that is movable relative to the handle, into a turning movement of the applicator member relative to the handle. The control member may be movable in a direction that is substantially parallel to the longitudinal axis of the handle.

U.S. Pat. No. 8,459,891 B2 to Lhoyer describes an applicator for a cosmetic product, which includes a container having an opening, a first wiper element coupled to the container, proximate the opening, and an applicator arrangement removably coupled to the container. The applicator arrangement includes an elongate hollow tube that is slidable through the first wiper element and has an opening defined by a rim at a distal end and a second handle at a proximal end. The rim defines a second wiper element, and the first handle is releasably fitted to the second handle. When the applicator arrangement is removed from the container the first wiper element scrapes excess cosmetic product from the applicator element and when the first handle is separated from the second handle the second wiper element scrapes excess cosmetic product from the applicator element.

U.S. Pat. No. 8,272,140 B2 to Goldstein et al. describes a bottle assembly that includes a bottle for storing a fluid, such as a cosmetic fluid. An applicator for applying the fluid is configured to be insertable and removable from the bottle along a path. A sealing body, or assembly, which may include one or more seals, is configured to continue to seal the bottle when the cap is removed.

U.S. Pat. No. 8,210,761 B2 to Bouix et al. describes a rigid low cost cosmetic container wherein the basic elements, a tubular container and an applicator wand, are integrally formed as a unitary body. The wand extends inwardly from the top of the container into a product reservoir to form of an applicator end. The wand extends upwardly from the top end of the container to form a handle which may be provided in dimensions approximating the cap on a saleable package. The container and wand are separated by a frangible connection in the top end of the container. The bottom margin of the container sidewall is provided with a substantially reduced thickness to permit the container to be pinched and hermetically sealed after the product reservoir is filled with a quantity of product.

U.S. Pat. No. 7,467,905 B2 to Habatjou describes an applicator that includes a support with a longitudinal axis. The support may include a stem, and a deformable portion including a first end and a second end, the deformable portion being arranged to deform elastically in a radial direction when a distance between the first and second ends is varied. The applicator may also include an applicator member fitted to the deformable portion between the first and second ends and extending continuously around the deformable portion. An adjuster element may be provided that is movable about at least the axis relative to the support and that is arranged to adjust the distance between the first and second ends of the deformable portion.

U.S. Pat. No. 7,374,358 B2 to Neuner et al describes a sealed wiper for a mascara bottle or other container that uses a wiper. The sealed wiper has novel venting features on its exterior to allow air that has been displaced from the container to escape to the outside. In this way, a sealed wiper may be seated on a container without the build up of pressure inside the container.

U.S. Pat. No. 3,469,928 to Widegren describes a mascara applicator comprising a mascara reservoir and an applicator wand providing a cap for the reservoir and having a depending brush normally retained in the reservoir and adapted for application of the mascara. The reservoir has a throat with an inwardly tapered opening for removing excess mascara from the brush when the wand withdrawn from the reservoir and the wand has a conical wiper element for wiping the throat opening clean when the wand is reinserted into the reservoir.

U.S. Pat. No. 2,814,420 to Elder Jr. et al. describes packages and containers for special purpose and, more particularly to a package and container for dispensing a predetermined quantity of a liquid.

United States Application No. 2011/0255912 A1 to Lhoyer describes an applicator for a cosmetic product, the applicator comprising a container for storing the cosmetic product, the container defining an opening, a first wiper element coupled to the container, proximate the opening of the container, and an applicator arrangement removably coupled to the container. The applicator arrangement includes a stem having an applicator element at a distal end and a first handle at a proximal end, the applicator element extending into the container for receiving cosmetic product. The applicator arrangement farther includes an elongate hollow tube that is slidable through the first wiper element, the hollow tube haying an opening defined by a rim at a distal end and a second handle at a proximal end, the rim defining a second wiper element, wherein the stem can be slidably accommodated within the hollow tube so that the applicator element of the stem can extend beyond the opening defined by the rim of the hollow tube. The first handle is releasably fitted to the second handle so that When the applicator arrangement is removed from the container the first wiper element scrapes excess cosmetic product from the applicator element and when the first handle is separated from the second handle the second wiper element scrapes excess cosmetic product from the applicator element.

United States Application No. 2008/0219747 A1 to Vanoncini describes a wiper device for containers of cosmetic products that comprises a wiper element to be mounted in a casing of a container for cosmetic products and designed to come into contact with an applicator housed in the casing, at least during pulling out of the applicator from the casing. The wiper device further comprises means for engagement of the wiper element with the casing and at least one seal to be installed close to an opening of the casing and adapted for abutment against a closing cap of the container, to ensure hermetic tightness or the container and avoid escape of the cosmetic product.

United States Application No. 2006/0198690 A1 to Neuner et al. describes a sealed wiper for a mascara bottle or other container that uses a wiper. The sealed wiper has novel venting features on its exterior to allow air that has been displaced from the container to escape to the outside. In this way, a sealed wiper may be seated on a container without the buildup of pressure inside the container.

United States Application No. 2006/0198689 A1 to Neuner et al. describes a vented wiper for a mascara bottle or other packaging. During filling of a container, the vented wiper allows air to vent from the mascara container other than through the interior of the wiper. The present invention also encompasses modified filling methods for containers that have wipers.

Notwithstanding the prior art, the present invention is neither taught nor rendered obvious thereby.

SUMMARY OF THE INVENTION

The present invention is a cosmetic container with a multifunctional insert, for receiving a cap and a cosmetic applicator, that may be utilized in the mascara or cosmetics industry or other field wherein a material is sufficiently fluid to be applied with a brush or other applicator from the container. The present invention cosmetic container with a multifunctional insert for receiving a cap and a cosmetic applicator, includes: a) a container having at least one sidewall, a bottom and an open top, the container having one of (a) a receiving groove and (b) at least one corresponding vertical one-way ratchet; b) an integral multifunctional insert neckpiece having a top view footprint corresponding to and for inserting into the open top of the container, the neckpiece having an outer perimeter wall, a top, an orifice in the top for receiving the applicator, and having a downcomer extending down from the orifice, the downcomer being a cosmetic wiper, the neckpiece further having an upper section with a cap attachment means, and having on its outer perimeter wall, the other of (a) at least one vertical one-way ratchet receiving groove and (b) at least one corresponding vertical one-way ratchet, to permit insertion thereof into the container and to inhibit removal thereof from the container when inserted.

In some embodiments of the present invention cosmetic container with a multifunctional insert, the at least one vertical one-way ratchet is a plurality of vertical one-way ratchets, and the at least one receiving groove is at least one continuous loop ratchet-receiving groove corresponding to the plurality of vertical one way ratchets.

In some embodiments of the present invention cosmetic container with a multifunctional insert, the neckpiece downcomer is a circular cosmetic wiper with a circular bottom opening.

In some embodiments of the present invention cosmetic container with a multifunctional insert, the cosmetic wiper is tapered inwardly downwardly.

In some embodiments of the present invention cosmetic container with a multifunctional insert, the cap attachment means is selected from the group consisting of a snap protrusion, a snap recess, and threading.

In some preferred embodiments of the present invention cosmetic container with a multifunctional insert, the cap attachment means is threading.

In some embodiments of the present invention cosmetic container with a multifunctional insert, the neckpiece has a top view footprint selected from the group consisting of circular, oval, polygonal and irregular.

In some embodiments of the present invention cosmetic container with a multifunctional insert, the neckpiece has a top view footprint that is circular.

In some embodiments of the present invention cosmetic container with a multifunctional insert, the inside of the sidewall of the container has one of (a) a horizontal one-way ratchet receiving groove and (b) at least one corresponding horizontal one-way ratchet to inhibit rotation of the neckpiece relative to the container, and the outer perimeter wall of the neckpiece has the other of the (a) a horizontal one-way ratchet receiving groove and (b) at least one corresponding horizontal one-way ratchet to inhibit rotation of the neckpiece relative to the container.

In some embodiments of the present invention cosmetic container with a multifunctional insert, the at least one horizontal one-way ratchet is a plurality of horizontal one-way ratchets, and the at least one receiving groove is at least one continuous loop ratchet-receiving groove corresponding to the plurality of horizontal one way ratchets. In some of these embodiments of the present invention cosmetic container with a multifunctional insert, the plurality of horizontal one-way ratchets are located on the neckpiece. In some of these embodiments of the present invention cosmetic container with a multifunctional insert, each of the plurality of horizontal one-way ratchets has a ratchet ramp with an angle of about 35 to about 55 degrees to the outer perimeter wall. In some of these embodiments of the present invention cosmetic container with a multifunctional insert, each of the plurality of horizontal one-way ratchets has a ratchet ramp with an angle of about 40 to about 50 degrees to the outer perimeter wall. In some of these embodiments of the present invention cosmetic container with a multifunctional insert, each of the plurality of horizontal one-way ratchets has a ratchet backstop with an angle of about 93 to about 97 degrees to the outer perimeter wall.

The present invention is also directed to a component described above, namely, a multifunctional insert neckpiece for insertion into a container, which includes: a single, integral multifunctional insert neckpiece having a top view footprint corresponding to and for inserting into an open top of the container, the neckpiece having an outer perimeter wall, a top, an orifice in the top for receiving the applicator, and having a downcomer extending down from the orifice, the downcomer being a cosmetic wiper, the neckpiece further having an upper section with a cap attachment means, and having on its outer perimeter wall, one of (a) at least one vertical one-way ratchet receiving groove and (b) at least one corresponding vertical one-way ratchet, to permit insertion thereof into the container and to inhibit removal thereof from the container when inserted. The multifunctional insert neckpiece is constructed of one or more molded or integrally-molded materials, and preferably a single molded piece, presented in a single homogenous structure which provides features for improved assembly, sealing, filling, metering, and dispensing of cosmetic and similar products.

In some embodiments of the present invention multifunctional insert neckpiece for insertion into a container, the neckpiece has at least one vertical one-way ratchet on its outer perimeter wall.

In some embodiments of the present invention multifunctional insert neckpiece for insertion into a container, the neckpiece has a circular top view and has one of (a) a horizontal one-way ratchet receiving groove and (b) at least one corresponding horizontal one-way ratchet to inhibit rotation of the neckpiece relative to the container, and the outer perimeter wall of the neckpiece has the other of the (a) a horizontal one-way ratchet receiving groove and (b) at least one corresponding horizontal one-way ratchet to inhibit rotation of the neckpiece relative to the container.

In some embodiments of the present invention multifunctional insert neckpiece for insertion into a container, the neckpiece has at least one horizontal one-way ratchet on its outer perimeter wall.

In some embodiments of the present invention multifunctional insert neckpiece for insertion into a container, the neckpiece has a plurality of horizontal one-way ratchets and each has a ratchet ramp with an angle of about 35 to about 55 degrees to the outer perimeter wall.

In some embodiments of the present invention multifunctional insert neckpiece for insertion into a container, each of the plurality of horizontal one-way ratchets has a ratchet backstop with an angle of about 93 to about 97 degrees to the outer perimeter wall.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION OF THE EMBODIMENTS

Figure 1:
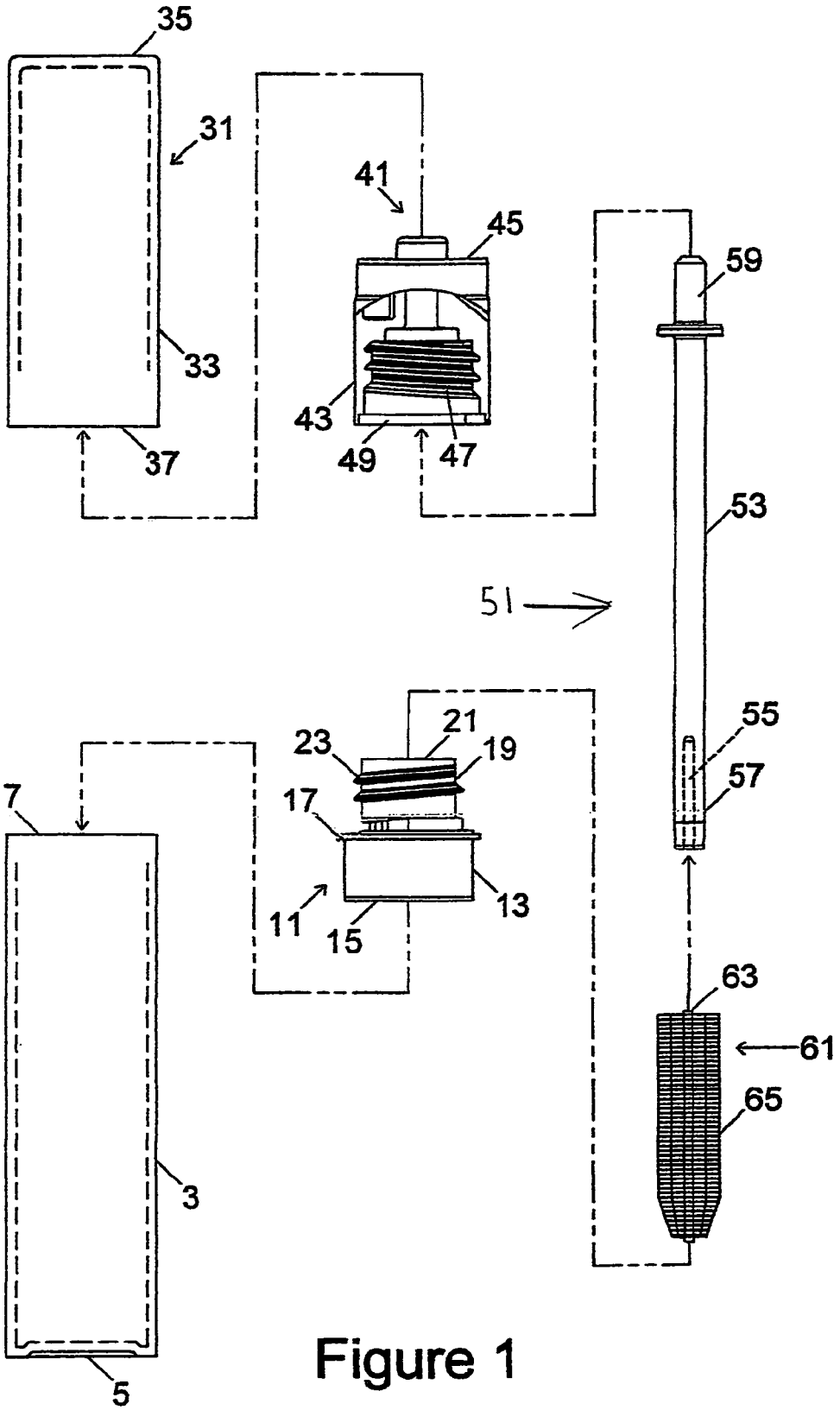
FIG. 1 is a front, partially cut, exploded view of one embodiment of the present invention cosmetic container with multifunctional insert neckpiece, and with a mascara brush and cap assembly.

The present invention relates to cosmetic and other containers that utilize a brush-type applicator, such as lip gloss, make-up, nail polish and especially mascara. Thus, the invention has applications in the fields of cosmetics, treatment products, pharmaceuticals, dental products, hair-care, consumer products, and industrial products.

The invention includes a container and a multifunctional insert neckpiece. This neckpiece allows for wipe mouthed containers for easier fill, and serves to perform multiple functions: the single piece insert neckpiece includes the locking mechanism for permanent connection to the container, includes a wiper that may be selected from a much broader range of sizes and shapes that was heretofore possible, includes the cap connection—snap fit, screw-on, or otherwise, and completely inhibits accidental removal of the wiper and subsequent loss of product and perhaps loss of customer.

Traditional containers for the above-stated types of uses have wipes at the necks to control the amount of content remaining on a brush, pad or other applicator when it is removed from the container. The containers are historically blow molded and have restricted necks to receive the wiper. Typical wipers are straight or tapered downcomers (pipes) with a lip. The wipers are inserted into the narrowed neck of the container after the container has been filled with product and the lip of the wiper holds it in place. While this has been the traditional design of these containers, also referred to as dispensers, inherent problems arise. For example, the narrower blow molded neck is sized to receive and hold the wiper, so even when the wiper has not been inserted, the fill rate is restricted by the constricted traditional neck. The present invention container has no constriction and may be filled at full width or cross-section area rates, e.g., up to four or five times faster filling. The present invention neckpiece is preferably unistructural and is molded with all necessary mechanisms in one shot, as mentioned, cap connection, container locking, and wiper diversity and wiper security. Further, when the container insert neck is circular, the single molded neckpiece also includes mechanisms to inhibit both upward removal, and unwanted lateral (rotational) movement, utilizing both vertical and horizontal ratcheting. The ratchets and ratchet receivers are interchangeable and one of the ratchet and receiver is on the neckpiece while the other of the ratchet and neckpiece is on the container. For illustrative purposes, the ratchets on the below Figures are on the neckpiece and the receiver slots are on the inside of the container, but they may be reversed in whole or in part.

Some of the detailed aspects of preferred embodiments of the present invention include: (a) Self-aligning ratchets (toothed splines) designed to perform as detents between the device and matching mating ratchets (splines) within the inner diameter of the containment vessel such that the ratchets resolve the torque of assembly and sealing during package filling and subsequent sealing torque in consumer use; (b) Integral sealing rings may be molded as appendages to the device that are designed to seal the device within mating containment vessels such that the cosmetic material or other content within the vessel is sealed within and protected from leakage, evaporation, and contamination; (c) Integral wiping system is molded within the opening of the device to provide desired and appropriate dispensing and doctoring of cosmetic products during application, with surfaces, diameters, and geometries designed to facilitate modification commensurate with formula requirements; (d) The wiper may have any opening and ending internal shapes as well as any wall profile within molding capabilities; (e) An integral shoulder of reduced diameter is designed to provide precise and repeatable assembly of the device into a mating product container (containment vessel) while simultaneously providing a means of concealing the shoulder within the product container for desirable aesthetic purposes; (f) Concentricallystepped internal and external diameters are designed to provide ideal functional performance of all key features within such a molded device such that the net diameter of a containment vessel designed to mate and function with such a device is capable of facilitating cosmetic package assemblies of any net diameter, and ideally packages of less than 25.00 MM diameter. Many of these significant features will be illustrated in the following drawings.

FIG. 1 is a front, partially cut, exploded view of one preferred embodiment of the present invention cosmetic container with multifunctional insert neckpiece, and with a mascara brush and cap assembly, generally references as assembly 1. This includes container 3, shown round here, but which could have any fixed or elevationally changing top view footprint shape. Further, it could have non-circular external features, such as oval or square top view footprints, while still maintaining a different internal shape at the top area where the insert id fitted, e.g., circular or otherwise. Container 3 has a closed bottom 5 and an open top 7. It has other internal functional features shown in more detail in FIGS. 5 through 10, below. Integral multifunctional insert neckpiece 11 has a top view footprint corresponding to and, for inserting into, the open top 7 of container 3. The neckpiece 11 has an outer perimeter wall 13 (with external detailed features not shown here, but shown in the below Figures, such as FIGS. 2, 3, 4, 5), a stop ledge 17, an open top 21, an orifice in the top 21 for receiving the applicator 51 (the open top 21 is shown in specific detail in Figures such as FIGS. 2 and 5 below), and external upper level 19 with threads 23, for receiving and removably connecting a cap/applicator assembly.

In FIG. 1, cap 31 has an open bottom 37, sidewall 33 and top 35. Threading and brush receiver plug 41 has a top 45, sidewall 43, open bottom 49 and threading 47, and it is permanently forced into the inside top of cap 31. Plug 41 and insert neckpiece 11 have corresponding threads but these could be replaced by alternative corresponding closure mechanisms, such as snap fit or otherwise, without exceeding the scope of the present invention. Also, plug 41 has a brush receiver aspect, typically a female receiver, to create permanent fit with flanged top 59 of brush rod 51. Cap 31, plug 41 and brush rod 51 are not critical aspects of the present invention, as they could be replaced by any other known cap and applicator assembly. Brush rod 51 has an elongated shaft 53 with a distal end 57 having a brush attachment means 63 (here, an elongated receiving orifice), and proximal end top 59. A brush rod indicator 61 includes brush bristles 65. An elongated receiving Office 55 is used for holding the brush rod indicator 61. The insert neckpiece 11 Includes a bottom 15 and a grooved piece 81.

Figure 2:
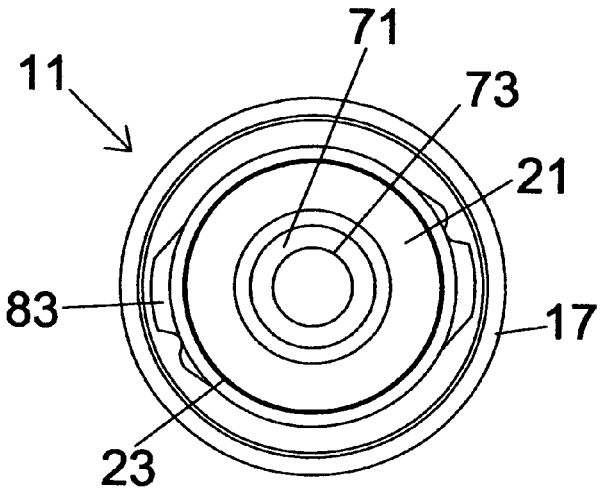
FIG. 2 is a top view and FIG. 3 is a front view of one embodiment of a preferred embodiment multifunctional insert neckpiece of the present invention cosmetic container.
Figure 3:
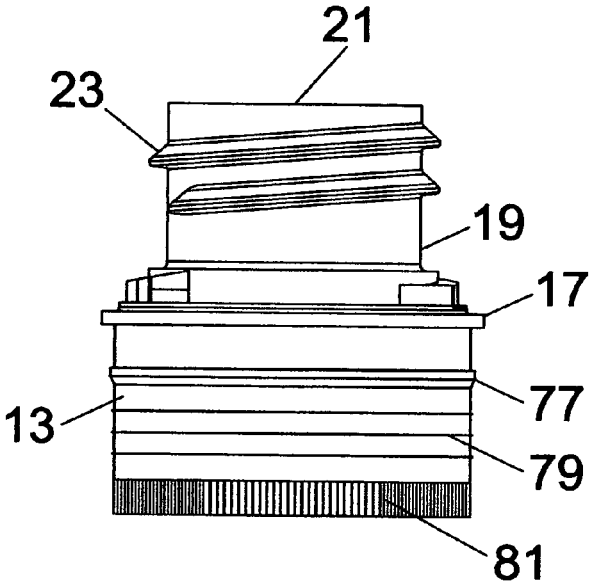
Figure 5:
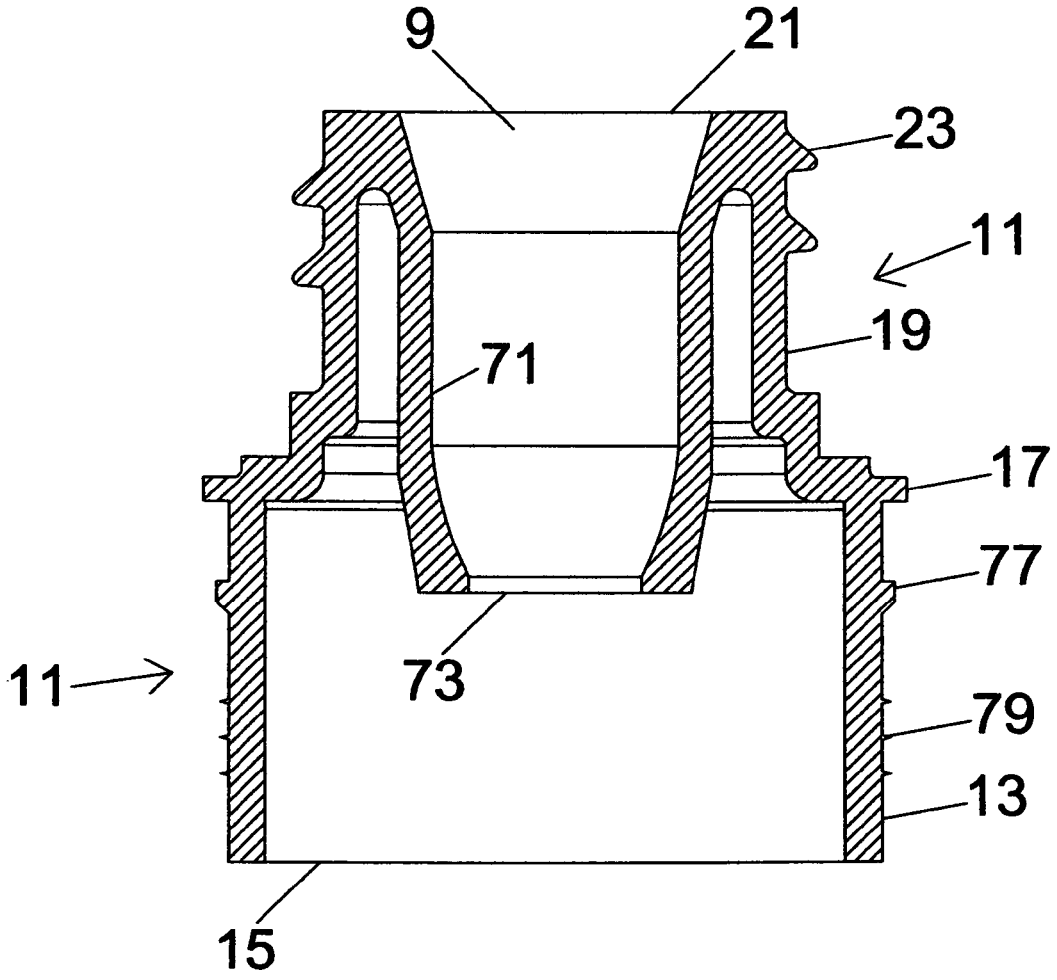
FIG. 5 is a front cut, view of the multifunctional insert neckpiece shown in FIG. 3.

FIG. 2 is a top view and FIG. 3 is a front view of the embodiment of a preferred embodiment multifunctional insert neckpiece 11 for insertion into a present invention cosmetic container. FIG. 5 is an enlarged, cut view of the FIG. 3 front view of neckpiece 11. (Identical parts that are identically numbered above need not be repeated herein, and identical parts that are identically numbered herein or above need not be repeated in subsequent drawings.) Taking FIGS. 2, 3 and 5 together, the details of sidewall 13 and the internal aspects of neckpiece 11 are now shown. Internally, there is an integrally formed wiper with a tapered "funnel" at open top 21, a cylindrical downcomer 71 that tapers towards wiper end 73. Wiper end 71 id the wiper blade that limits the amount of content that is removed as an applicator has been dipped and is removed from the container.

All elements of this neckpiece 11 are integrally formed (molded into a single piece), including external threads 23 on upper level 19 (which may have a larger, smaller or the same outer dimension as sidewall 13). Sidewall 13 has its details shown here, including the stop ledge 17, vertical one-way ratchet 77 that locks the neckpiece 11 into the neck of a container having a complementary receiving groove (same or similar profile), when inserted therein. External, integrally formed, plural sealing rings, such as ring 79, circumvent the Neckpiece and, when assembled, seal the neckpiece to the container to assist in maintaining content integrity and moisture. Horizontal ratchets 81 act to prevent twisting of the neckpiece 11 relative to a container when the cap is removed, and acts as a stop when the cap is returned, with less resistance and may permit contra-rotation before breaking, if designed to do so (i.e., ratchets may eventually slide over its receiving recess when designed as such and sufficient force is applied in the direction away from the ratchet stop walls).

Figure 4:
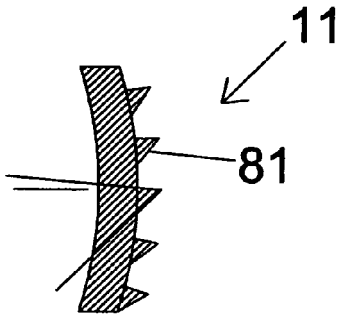
FIG. 4 is partial cut view detailing the horizontal one-way ratchets on the outside base of the multifunctional insert neckpiece of FIG. 3.

FIG. 4 is partial cut view detailing the horizontal one-way ratchets on the outside base of the multifunctional insert neckpiece 11 of FIG. 3, to illustrate some preferred angle features. Here, the ratchet ramps of horizontal one-way ratchets 81 are set at 45 degrees from the radius line and this is ideal for the cosmetic lip and mascara containers, as well as others mentioned above. For less contra-rotation (here clockwise) resistance, smaller angles are preferred and for increased contra-rotation resistance, larger angles are preferred. Thus, these angles may range from 25 degrees to 60 degrees and the preferred angles are about 35 to about 55 degrees to the outer perimeter wall and to the radius, 40 to 50 degrees are most preferred. In addition to the ramp angles, it has surprisingly been discovered that ideal ratchet backstops are not parallel to the radii, but should be increased from zero to a slightly greater angle, and in this embodiment 5 degrees off radius (base of backstop away from ramp, as shown). As measured from the perimeter wall, that angle would be 5 degrees plus 90 degrees, i.e., 95 degrees. Thus the horizontal ratchet backstop preferred angle is about 93 to about 97 degrees to the outer perimeter wall.

The neckpiece 11 has an outer perimeter wall 13 (with detailed features not shown here, but shown in the below Figures, such as FIGS. 2, 3, 4, 5), an open top 21 (the open top 21 is shown in specific detail in Figures such as FIGS. 2 and 5 below), an orifice in the top 21 for receiving the applicator 51 applicator, and having a downcomer extending down from said orifice, said downcomer being a cosmetic wiper, said neckpiece further having an upper section with a cap attachment means, and having on its outer perimeter wall, the other of (a) at least one vertical one-way ratchet receiving groove and (b) at least one corresponding vertical one-way ratchet, to permit insertion thereof into said container and to inhibit removal thereof from said container when inserted.

Figure 6:
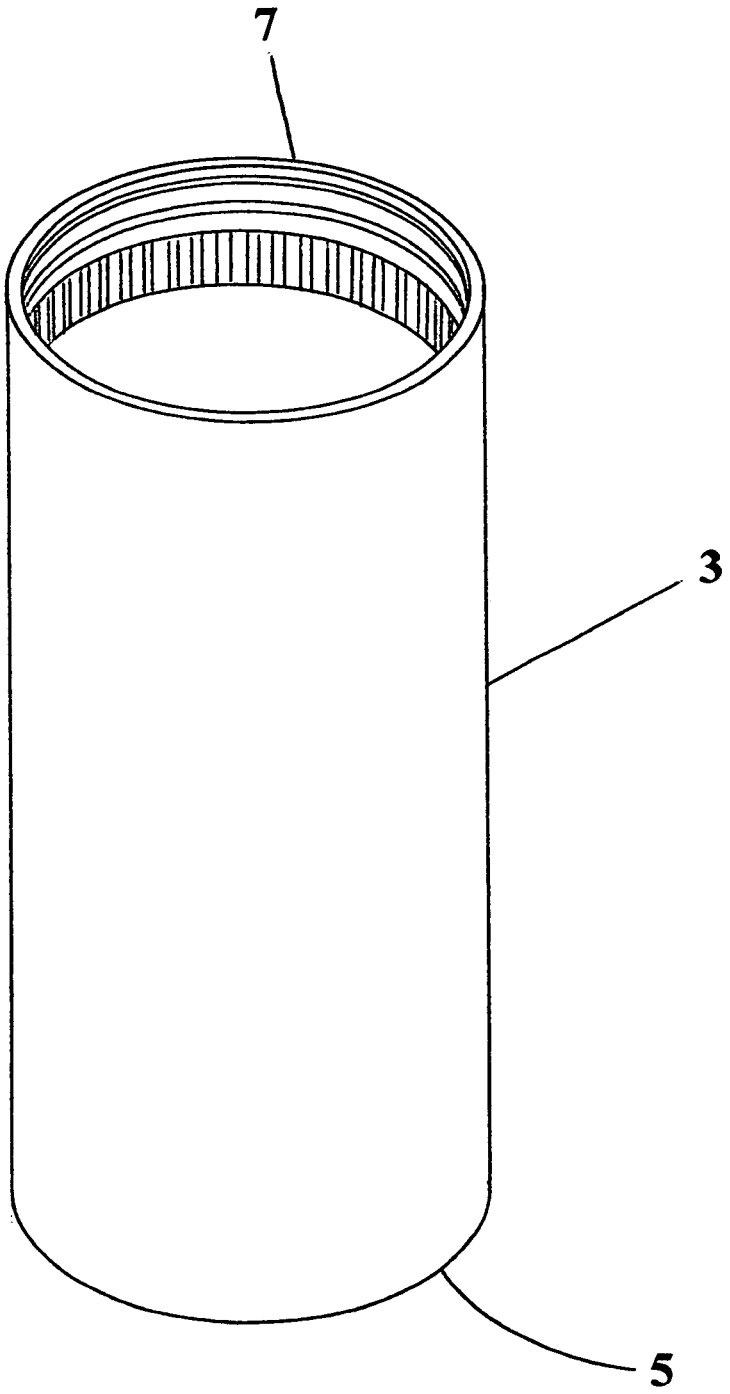
FIGS. 6, 7 and 8 illustrate a front oblique view, a front cut view and partial, cut blow-up of the open top area of one preferred embodiment of a present invention container.
Figure 8:
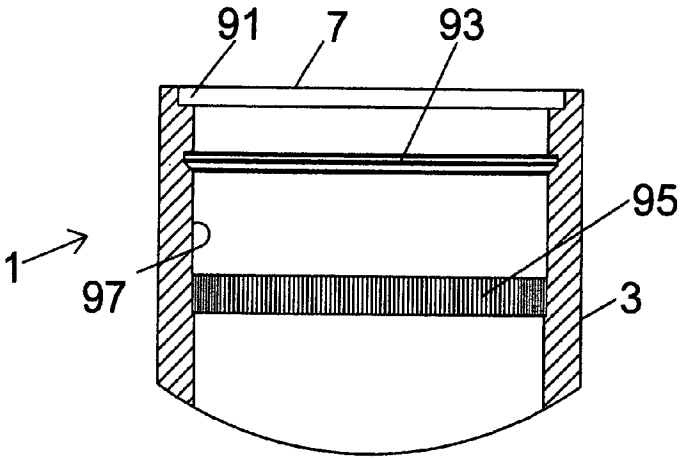
Figure 7:
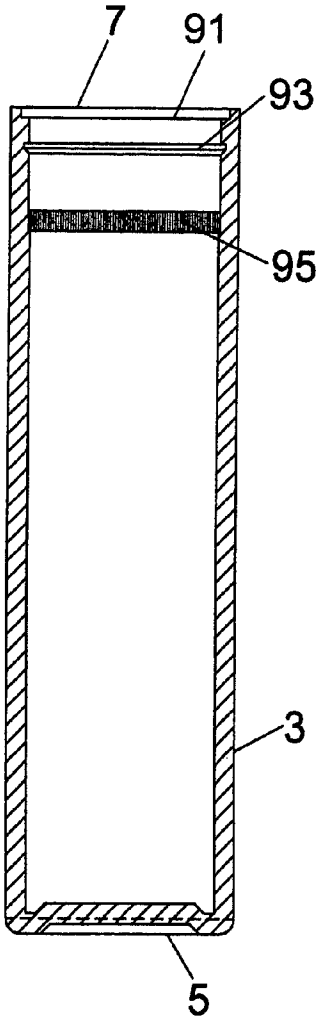

FIGS. 6, 7 and 8 illustrate a front oblique view, a front cut view and partial, cut blow-up of the open top area of one preferred embodiment of the present invention container 1 that functions to receive neckpiece 11 described in detail above. These three Figures are discussed here simultaneously. Container 1 is cylindrical, but could have many different shapes and the external shape need not correspond to the internal shape. Likewise, the neck of the container may have a different shape. Ideally, but not required, is a container that is cylindrical with the same internal and external shape and general wall thickness and wherein the neck has the same inside diameter as the rest of the container. Container 1 is such a container and it is most easily molded and has a significant fill advantage, as the wide neck (or mouth, as it is sometimes called) allows for rapid fill times and accurate fills that could increase processing by 50% to more than double the speed. It is contemplated that content would be filled into the container and subsequently, the neckpiece would be inserted, in some cases, with the cap and applicator in place, although some existing assembly lines would attach the cap and applicator assembly after the container is filled and the neckpiece is in place.

Figure 9A:
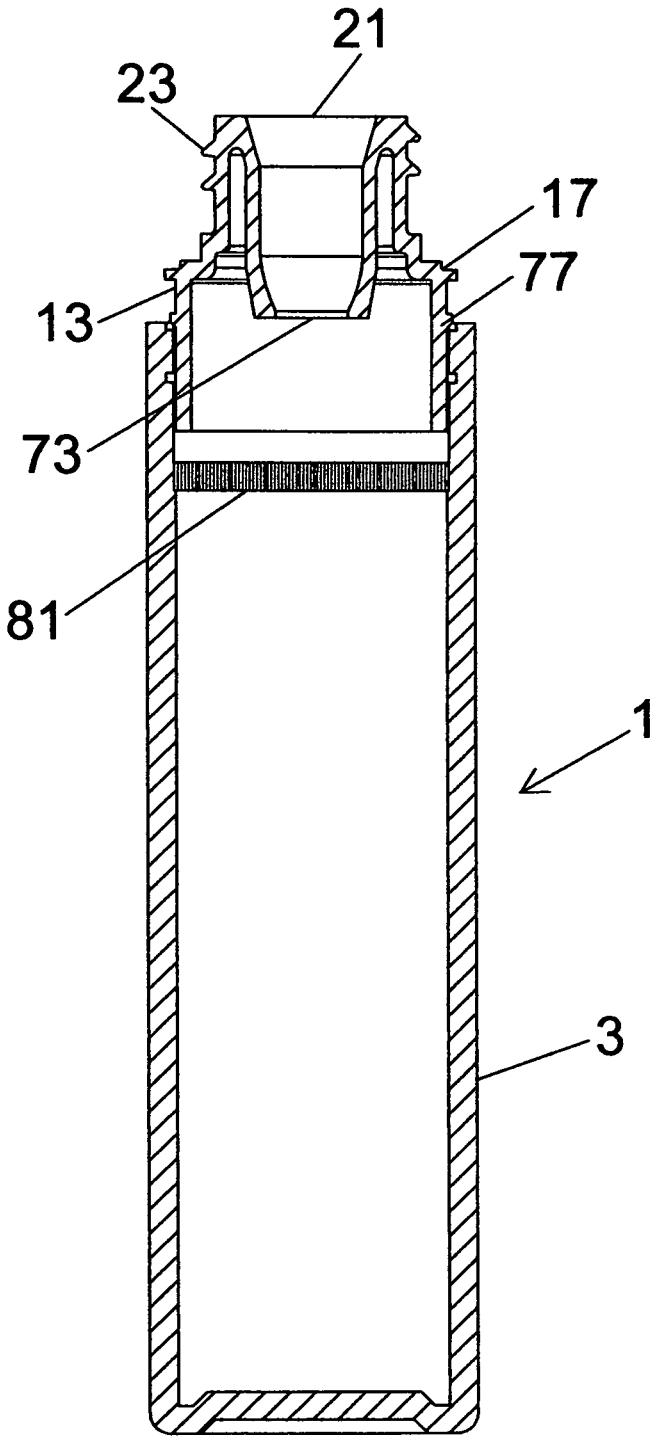
FIG. 9*a* illustrates a front cut view of the present invention cosmetic container with a multifunctional insert neckpiece partially inserted and FIG. 9*b* shows a sectional detail thereof.
Figure 9B:
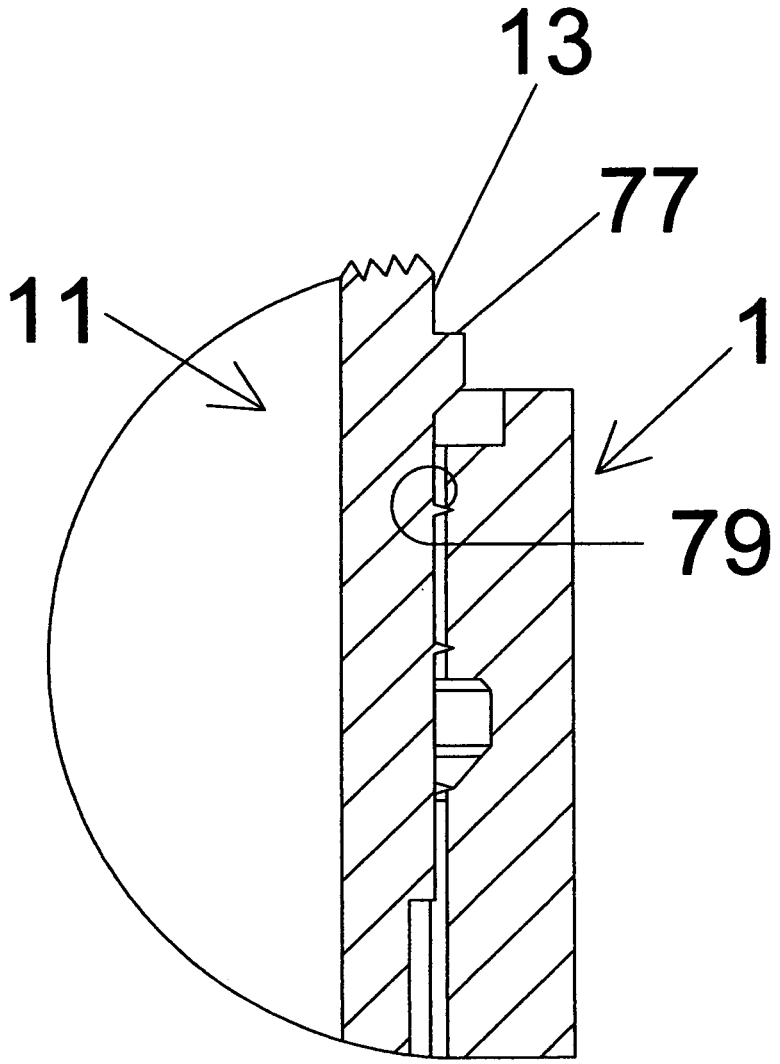
Figure 10A:
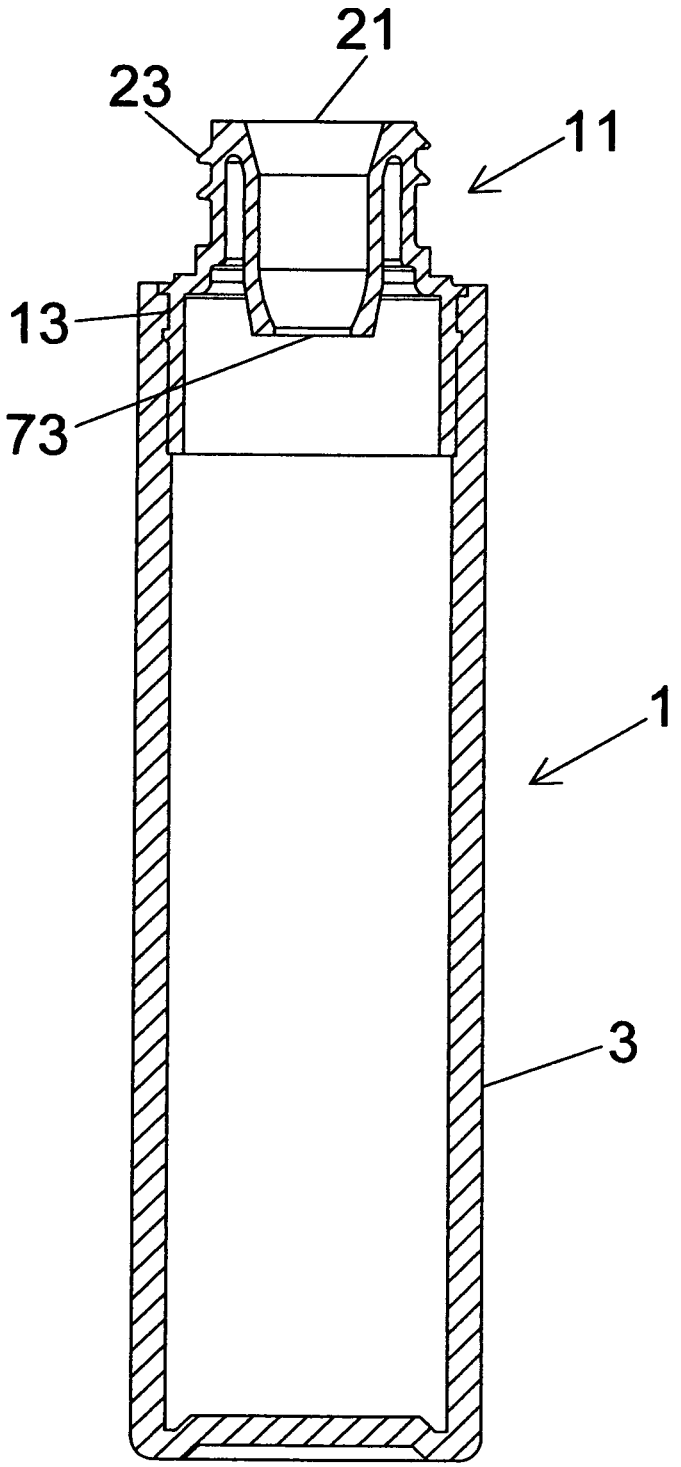
FIG. 10*a* illustrates a front cut view of the present invention cosmetic container with a multifunctional insert neckpiece fully inserted and FIG. 10*b* shows a sectional detail thereof.
Figure 10B:
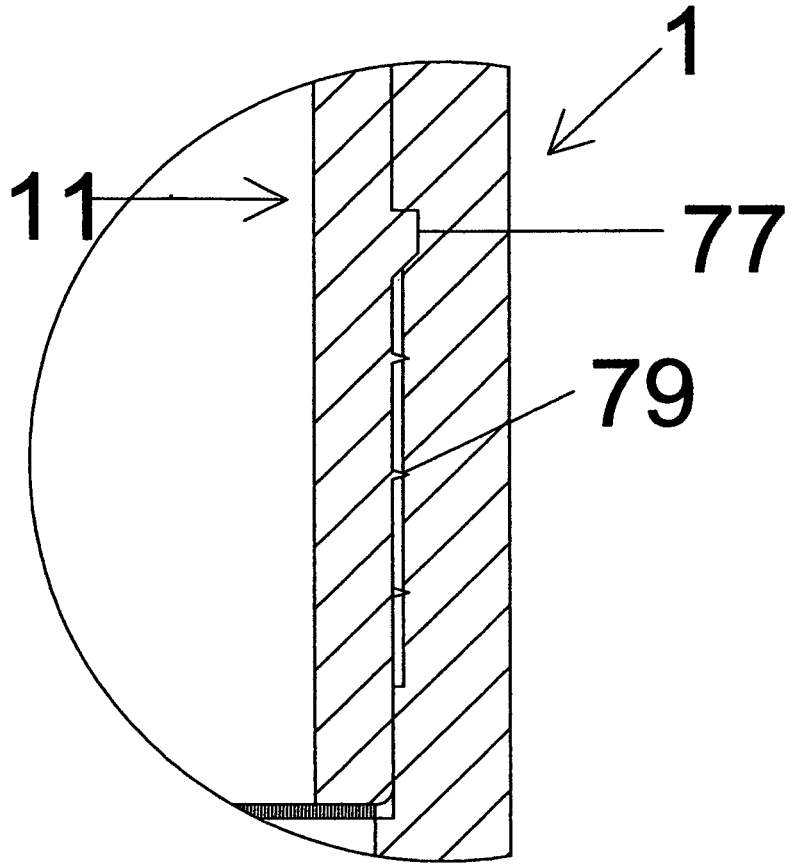

Referring to these FIGS. 6, 7 and 8, container 1 has an internal rest ledge for neckpiece stop ledge 17, a vertical ratchet receiving groove 93 for neckpiece vertical ratchet 77, and a horizontal ratchet receiving groove 95 (for neckpiece horizontal ratchets 81) with complementary ratchet recesses. In FIG. 8, there is a receiving recess 91 for the neckpiece which abuts a sidewall 97. This container 1 is preferably first filled with content, such as lip gloss, mascara, derma-medicine, foundation powder, or other desired product. Next neckpiece 11 is entered into open top 7 of container 1. FIG. 9*a* illustrates a front cut view of the present invention cosmetic container 1 with the multifunctional insert neckpiece 11 partially inserted and FIG. 9*b* shows a sectional detail thereof. The external features of sidewall 13 of neckpieces 11 are moving downward to set into its proper permanent engagement position. FIG. 10*a* illustrates a front cut view of the present invention cosmetic container 1 with the multifunctional insert neckpiece 11 fully inserted and FIG. 10*b* shows a sectional detail thereof, wherein vertical one-way ratchet 77 is seated in its container receiver, seal rings, such as seal ring 79, are in the place and have fully sealed the space between the two components, and horizontal ratchets 81 are seated in their corresponding container groove. The results are multifaceted, synergistic and allow for a single molded neckpiece to provide rapid fill, vertical movement locking, cap threading, multiple circumferential sealing, optimal wiping, and rotational control.

FIGS. 11, 12, 13 and 14 show some examples of other shapes that may be used for the present invention devices.

Figure 11:
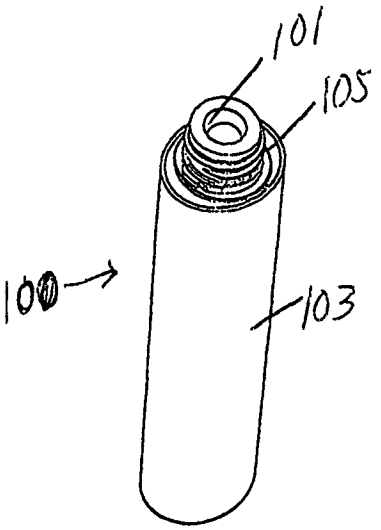
Figure 12:
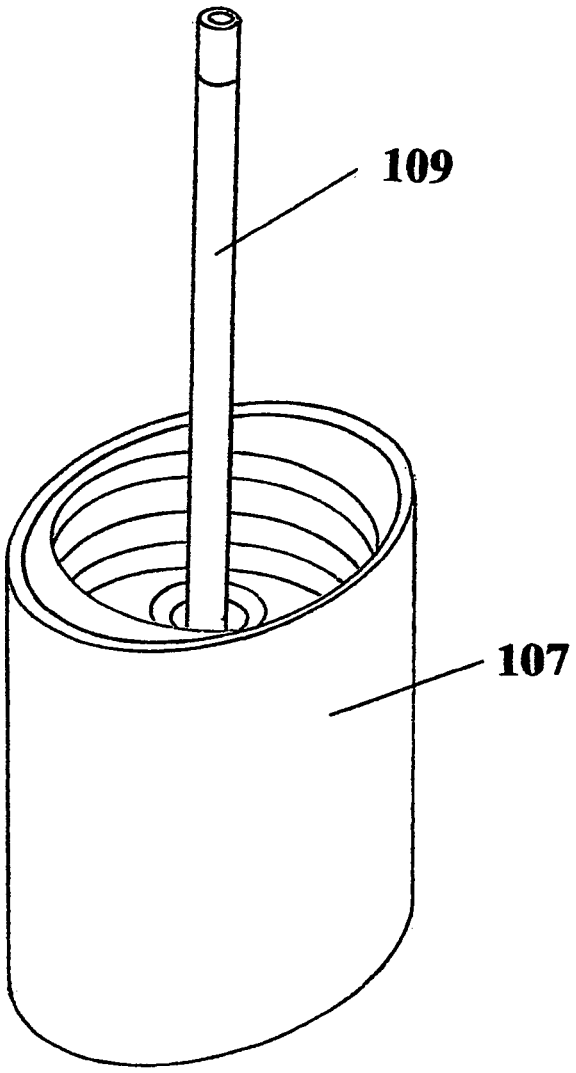

In FIG. 11, there is shown a present invention device 100 with a container 103 that is oval inside and out, and the inserted neckpiece 101 has an oval base section and a circular upper section with threads 105. In FIG. 12, the mate to the FIG. 11 present invention device, cap assembly 107 with applicator 109, maintains an oval external shape corresponding to the container 101, yet has circular internal features matching the upper section of neckpiece 101 and threads 105.

Figure 14:
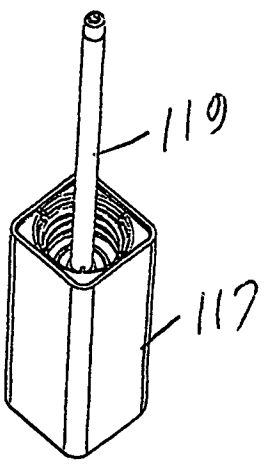
FIGS. 11, 12, 13 and 14 show other shapes that may be used for the present invention devices; and, FIG. 15 shows a block diagram illustrating various features and option for the present invention cosmetic container with multifunctional insert.
Figure 13:
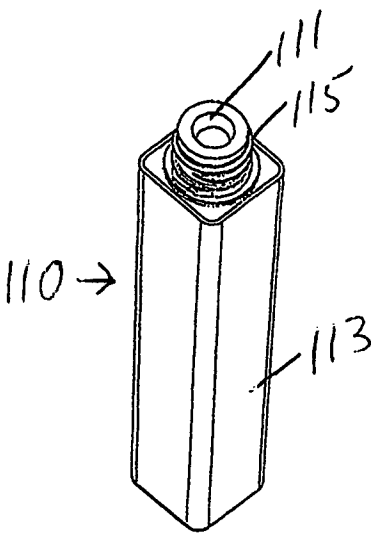

In FIG. 13, there is shown another present invention device 110 with a container 113 that is square inside and out, and the inserted neckpiece 111 has a square base section and a circular upper section with threads 115. In FIG. 14, the mate to the present invention FIG. 13 device, cap assembly 117 with applicator 119, maintains a square external shape corresponding to the container 111, yet has circular internal features matching the upper section of neckpiece 111 and threads 115.

Figure 15:
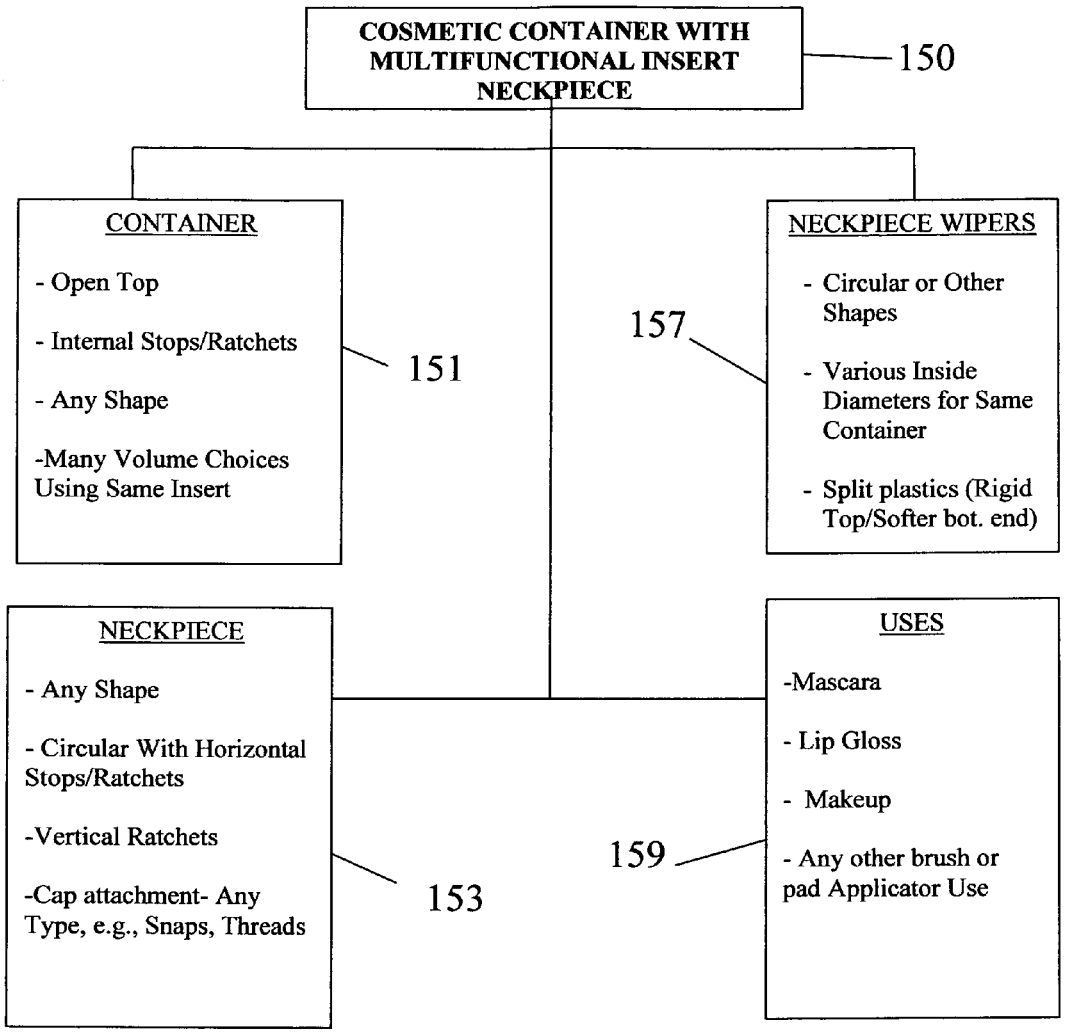

FIG. 15 shows a block diagram illustrating various features and option for the present invention cosmetic container with multifunctional inserted neckpiece, block 150. Block 151 sets forth various container configurations, block 153 sets forth various neckpiece configurations, block 157 sets forth various neckpiece wiper configurations, and block 159 describes some possible present invention device uses.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims. For example, some of the attachment mechanisms, locks, shapes, and other mechanisms may be different from the examples described, e.g., they may be partial, rather than full length, or may be at multiple points rather than continuous, or may have irregular configurations or shapes.

What is claimed is:

1. A cosmetic container with a multifunctional insert for receiving a cap and a cosmetic applicator, which comprises:

a) a container having at least one sidewall, a bottom and an open top, said container having one of (a) a receiving groove and (b) at least one corresponding vertical one-way ratchet;

b) an integral multifunctional insert neckpiece having a top view footprint corresponding to and for inserting into said open top of said container, said neckpiece having an outer perimeter wall, a top, an orifice in said top for receiving said applicator, and having a downcomer extending down from said orifice, said downcomer being a cosmetic wiper, said neckpiece further having an upper section with a cap attachment means, and having on said neckpiece outer perimeter wall, the other of (a) at least one vertical one-way ratchet receiving groove and (b) at least one corresponding vertical one-way ratchet, to permit insertion thereof into said container and to inhibit removal thereof from said container when inserted;

wherein said neckpiece has a top view footprint that is circular and wherein said inside of said sidewall of said container has one of (a) a horizontal one-way ratchet receiving groove and (b) at least one corresponding horizontal one-way ratchet to inhibit rotation of said neckpiece relative to said container, and the outer perimeter wall of said neckpiece has the other of said (a) a horizontal one-way ratchet receiving groove and (b) at least one corresponding horizontal one-way ratchet to inhibit rotation of said neckpiece relative to said container.

2. The cosmetic container with a multifunctional insert of claim 1 wherein said at least one vertical one-way ratchet is a plurality of vertical one-way ratchets, and said at least one receiving groove is at least one continuous loop ratchet-receiving groove corresponding to said plurality of vertical one way ratchets.

3. The cosmetic container with a multifunctional insert of claim 1 wherein said neckpiece downcomer is a circular cosmetic wiper with a circular bottom opening.

4. The cosmetic container with a multifunctional insert of claim 3 wherein said cosmetic wiper is tapered inwardly downwardly.

5. The cosmetic container with a multifunctional insert of claim 1 wherein said cap attachment means is selected from the group consisting of a snap protrusion, a snap recess, and threading.

6. The cosmetic container with a multifunctional insert of claim 1 wherein said at least one horizontal one-way ratchet is a plurality of horizontal one-way ratchets, and said at least one receiving groove is at least one continuous loop ratchet-receiving groove corresponding to said plurality of horizontal one way ratchets.

7. The cosmetic container with a multifunctional insert of claim 6 wherein said plurality of horizontal one-way ratchets are located on said neckpiece.

8. The cosmetic container with a multifunctional insert of claim 7 wherein each of said plurality of horizontal one-way ratchets has a ratchet ramp with an angle of about 35 to about 55 degrees to said outer perimeter wall.

9. The cosmetic container with a multifunctional insert of claim 7 wherein each of said plurality of horizontal one-way ratchets has a ratchet ramp with an angle of about 40 to about 50 degrees to said outer perimeter wall.

10. A cosmetic container with a multifunctional insert for receiving a cap and a cosmetic applicator, which comprises:

a) a container having at least one sidewall, a bottom and an open top, said container having one of (a) a receiving groove and (b) at least one corresponding vertical one-way ratchet;

b) an integral multifunctional insert neckpiece having a top view footprint corresponding to and for inserting into said open top of said container, said neckpiece having an outer perimeter wall, a top, an orifice in said top for receiving said applicator, and having a downcomer extending down from said orifice, said downcomer being a cosmetic wiper, said neckpiece further having an upper section with a cap attachment means, and having on said neckpiece outer perimeter wall, the other of (a) at least one vertical one-way ratchet receiving groove and (b) at least one corresponding vertical one-way ratchet, to permit insertion thereof into said container and to inhibit removal thereof from said container when inserted;

wherein said neckpiece has a top view footprint that is circular and wherein said inside of said sidewall of said container has one of (a) a horizontal one-way ratchet receiving groove and (b) at least one corresponding horizontal one-way ratchet to inhibit rotation of said neckpiece relative to said container, and the outer perimeter wall of said neckpiece has the other of said (a) a horizontal one-way ratchet receiving groove and (b) at least one corresponding horizontal one-way ratchet to inhibit rotation of said neckpiece relative to said container, wherein said at least one corresponding horizontal one-way ratchet has a ratchet backstop with an angle of about 93 to about 97 degrees to said outer perimeter wall.

11. The cosmetic container with a multifunctional insert of claim 10 wherein said at least one vertical one-way ratchet is a plurality of vertical one-way ratchets, and said at least one receiving groove is at least one continuous loop ratchet-receiving groove corresponding to said plurality of vertical one way ratchets.

12. The cosmetic container with a multifunctional insert of claim 10 wherein said cosmetic wiper is tapered inwardly downwardly.

13. The cosmetic container with a multifunctional insert of claim 12 wherein said neckpiece downcomer is a circular cosmetic wiper with a circular bottom opening.

14. The cosmetic container with a multifunctional insert of claim 10 wherein said cap attachment means is selected from the group consisting of a snap protrusion, a snap recess, and threading.

15. The cosmetic container with a multifunctional insert of claim 10 wherein said neckpiece has a top view footprint that is circular and wherein said inside of said sidewall of said container has one of (a) a horizontal one-way ratchet receiving groove and (b) at least one corresponding horizontal one-way ratchet to inhibit rotation of said neckpiece relative to said container, and the outer perimeter wall of said neckpiece has the other of said (c) a horizontal one-way ratchet receiving groove and (d) at least one corresponding horizontal one-way ratchet to inhibit rotation of said neckpiece relative to said container.

16. The cosmetic container with a multifunctional insert of claim 10 wherein said at least one horizontal one-way ratchet is a plurality of horizontal one-way ratchets, and said at least one receiving groove is at least one continuous loop ratchet-receiving groove corresponding to said plurality of horizontal one way ratchets and wherein said plurality of horizontal one-way ratchets are located on said neckpiece.

17. The cosmetic container with a multifunctional insert of claim 16 wherein each of said plurality of horizontal one-way ratchets has a ratchet ramp with an angle of about 35 to about 55 degrees to said outer perimeter wall.

18. The cosmetic container with a multifunctional insert of claim 16 wherein each of said plurality of horizontal one-way ratchets has a ratchet ramp with an angle of about 40 to about 50 degrees to said outer perimeter wall.

19. A multifunctional insert neckpiece for insertion into a container, which comprises:

a single, integral multifunctional insert neckpiece having a top view footprint corresponding to and for inserting into an open top of said container, said neckpiece having an outer perimeter wall, a top, an orifice in said top for receiving an applicator, and having a downcomer extending down from said orifice, said downcomer being a cosmetic wiper, said neckpiece further having an upper section with a cap attachment means, and having on said outer perimeter wall, one of (a) at least one vertical one-way ratchet receiving groove, and (b) at least one corresponding vertical one-way ratchet, to permit insertion thereof into said container and to inhibit removal thereof from said container when inserted; and, said neckpiece having a circular top view and having on its outer perimeter wall, one of (a) a plurality of horizontal one-way ratchet receiving grooves, and (b) a plurality of corresponding horizontal one-way ratchets, to inhibit rotation of said neckpiece relative to said container, and wherein each of said plurality of horizontal one-way ratchets has a ratchet ramp with an angle of about 35 to about 55 degrees to said outer perimeter wall and wherein each of said plurality of horizontal one-way ratchets has a ratchet backstop with an angle of about 93 to about 97 degrees to said outer perimeter wall.

* * * * *